United States Patent [19]

Zellweger

[11] Patent Number: 4,799,319

[45] Date of Patent: Jan. 24, 1989

[54] DEVICE FOR WARMING THE FOOT OF A WEARER

[76] Inventor: Max Zellweger, Alte Wollerauerstrasse 36, CH 8805 Richterswil, Switzerland

[21] Appl. No.: 62,676

[22] Filed: Jun. 16, 1987

[30] Foreign Application Priority Data

Jun. 18, 1986 [CH] Switzerland ..... 2459/86

[51] Int. Cl.[4] ..... A43B 07/02; A43B 13/18

[52] U.S. Cl. ..... 36/2.6; 36/29

[58] Field of Search ..... 36/2.6, 43, 44, 28, 36/29, 38; 128/594

[56] References Cited

U.S. PATENT DOCUMENTS

| | | | |
|---|---|---|---|
| 547,645 | 10/1895 | Lacroix | 36/29 |
| 1,069,001 | 7/1913 | Guy | 36/29 |
| 1,605,985 | 11/1926 | Rasmussen | 36/29 |
| 2,177,116 | 10/1939 | Persichino | 36/29 |
| 3,871,117 | 3/1975 | Richmond et al. | 36/43 |
| 3,922,801 | 12/1975 | Zente | 36/44 |
| 3,990,457 | 11/1976 | Voorhees | 128/594 |
| 4,123,855 | 11/1978 | Thedford | 36/44 |
| 4,229,889 | 10/1980 | Petrosky | 36/29 |
| 4,340,626 | 7/1982 | Ridy | 36/29 |
| 4,446,634 | 5/1984 | Johnson et al. | 36/43 |
| 4,458,430 | 7/1984 | Peterson | 36/29 |

FOREIGN PATENT DOCUMENTS

| | | | |
|---|---|---|---|
| 2766684 | 5/1984 | Australia . | |
| 1164720 | 10/1958 | France | 36/29 |
| 124753 | 1/1927 | Switzerland | 36/26 |
| 1448583 | 9/1976 | United Kingdom . | |
| 2073006 | 10/1981 | United Kingdom | 36/29 |

*Primary Examiner*—Steven N. Meyers

*Attorney, Agent, or Firm*—Hill, Van Santen, Steadman & Simpson

[57] ABSTRACT

A device for warming the foot during walking which includes an inner sole defining a plurality of longitudinally communicating closed cavities which deform under compressive stress. The cavities each contain a fluid therein and a constriction is positioned between the cavities whereby heat is generated as the fluid passes through the constriction during alternating application of stresses on the cavities during walking.

10 Claims, 1 Drawing Sheet

DEVICE FOR WARMING THE FOOT OF A WEARER

BACKGROUND OF THE INVENTION

1. Field of the Invention

The present invention deals with a device forming part of a shoe or being insertable into a shoe to generate heat without the use of external energy.

2. DESCRIPTION OF THE PRIOR ART

In the case of ski boots, in particular, it is known to install an electrical resistance heater in the inner sole, the heater being actuated by a battery. A device of this type has the disadvantage that the generation of heat is dependent on an external energy source which has to be replaced at regular intervals.

Heat-insulating insoles are also known which, although they more or less effectively prevent the undesirable escape of heat, are not designed to generate heat.

Published Australian patent application No. 27,666/84 disclosed an insole for shoes consisting of two plastic films welded together at their edges and defining a cavity filled with a fluid. The fluid was locally displaced by the rolling motion of the foot and was thus moved within the cavity. In order to prevent the fluid from being displaced from the rear to the front and vice versa by the direct route, baffles in the form of partitions were arranged within the cavity. This type of insole serves to absorb the impacts arising during walking and exerts a certain massage effect, but does not cause any evolution of heat to take place.

An insole of a similar type is shown in U.S. Pat. No. 3,871,117. This insole likewise evidences a cavity filled with a fluid with the cavity being subdivided by partitions into a large number of chambers. The cavity is connected in the region of the toes and in the region of the heel to a cooling system arranged in the footwear through which the fluid is forced out of the cavity during walking. In order to insure a directed flow from the toes to the heel and then through the cooling system, a system of valves is positioned within the cavity. In the case of this sole, specific measures are taken to prevent evolution of heat in the shoe.

U.S. Pat. No. 4,123,855 likewise discloses an insole of the type mentioned which consists of two films connected to one another along their edges and serving to confine a fluid-filled cavity. The cavity is likewise subdivided by baffles which are formed by partitions. These baffles prevent the fluid from being displaced from rear to front and vice versa by direct flow during walking. This construction contemplates an increased massage effect. The insole is further provided with a number of continuous ventilation apertures which extend transversely to the longitudinal dimension of the sole. The purpose of the ventilation aperture is to prevent warming of the foot so that this sole also provides means for counteracting the evolution of heat in the footwear.

SUMMARY OF THE INVENTION

The present invention seeks to provide an inner sole as part of a shoe or as a replaceable insert which makes it possible for heat to be generated in a simple and reliable manner without the use of an external energy source. Specifically, the device of the present invention includes an inner sole defining a plurality of longitudinally communicating closed cavities which deform under compressive stress, the cavities each containing a fluid therein. A constriction which may include a flow restrictor is located between the cavities whereby heat is generated as the fluid passes through the constriction means during alternating application of stresses on tee cavities during walking. In the device of the present invention, at least one cavity is situated in the heel region and the other in the region of the ball of the foot or the toes, with the flow restrictor being located in the region of the arch of the foot.

The present invention utilizes the alternating load which automatically occurs, during walking, in the region of the heel and of the ball of the foot or of the toes. When the heel is placed on the ground, the device of the present invention causes a liquid or gaseous medium to be conveyed from a cavity located in the heel zone to a cavity situated in the toes or the ball of the foot. In so moving, the fluid is pressed through a flow restriction point which acts as a constriction in the flow path of the fluid medium. If subsequently a pressure is exerted in the region of the ball of the foot or the toes on the cavity situated in that region, the fluid medium is forced back again through the flow restriction point into the other cavity. Each time the medium is pressed through the flow restriction point, heat is generated by friction in the sole which helps to warm the foot of the wearer.

BRIEF DESCRIPTION OF THE DRAWINGS

The present invention is illustrated in several exemplary embodiments in the sheet of drawings in which.

DESCRIPTION OF THE PREFERRED EMBODIMENTS

Figure 1:
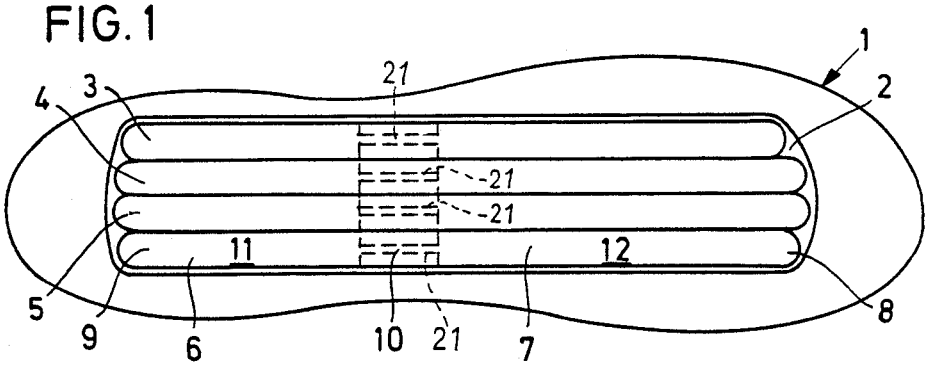
FIG. 1 illustrates a longitudinal section through an inner sole of a shoe having a device for generating heat.

The embodiments shown in FIG. 1 illustrates an inner sole 1 having a recess 2 formed therein. The recess 2 serves to receive the device for heat generation which can be activated during walking.

The inner sole 1 can be designed either as part of the foot support of a shoe or as a separate insole which is inserted into a shoe. If the sole 1 is part of a shoe, the recess 2 is preferably situated in the inner sole and in part of the leather of the sole. The sole 1 can consist of rubber or a plastic material of varying thickness and contour. The sole 1 is preferably made of a foamed plastic material.

The device for heat generation located in the recess 2 is composed, as shown in FIG. 1, of a plurality of hollow members 3, 4, 5 and 6 all of identical configuration. Each hollow member 3 to 6 consists of a tube 7 which is sealed at its ends 8 and 9, and containing a flow restrictor 10 intermediate its ends. The flow restrictor 10 divides the hollow members 3 to 6 into two partial cavities identified at reference numerals 11 and 12 which are located in the region of the heel and at the ball of the foot, respectively. The flow restrictors 10 are positioned approximately in the middle region of the sole 1, i.e., in the region of the arch of the foot.

The tube 7 consists of a flexible material such as a plastic of low elasticity and may have a circular, oval, rectangular or polygonal or other suitable cross-section. If a narrow rectangular cross-section is provided for the tube 7, the tubes form a plate-shaped member of slight thickness which can be readily accommodated in the sole 1.

Figure 2:
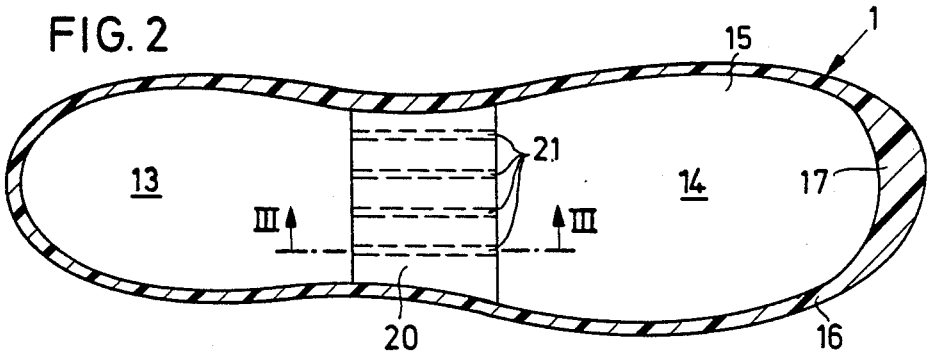
FIG. 2 illustrates a longitudinal section of a further embodiment of an inner sole having a device for generating heat.

A further embodiment of the sole 1 is shown in FIG. 2 in which embodiment there is a single partial cavity 13 or 14 instead of the partial cavities 11 and 12 of FIG. 1. The sole 1 includes a closed cavity 15 which is surrounded by an elastically deformable wall 16 shown in cross-section. The wall thickness of the wall 16 can be designed as required, and the wall 16 can possess wall thicknesses of different thicknesses as, for example, in the toe region 17 in which the wall thickness is increased. The two part cavities 13 and 14 are separated from one another by a flow restrictor 20 which is positioned in the region of the arch of the foot.

In both embodiments, the flow restrictors 10 and 20 provide restricting channels 21 which connect the partial cavities 11, 12 13, and 14 to each other. The partial cavities 11, 12, 13 and 14 are filled with a suitable liquid or gas. It is preferable to employ a fluid which exhibits a substantially constant viscosity at the temperatures encountered, namely, between −30° C. and +40° C.

During walking, a greater pressure is alternately exerted on one of the deformable cavities 11, 12, 13 and 14 then on the other cavity. As a result the fluid is displaced between the cavities. During the rolling motion of the foot, the fluid is therefore pressed from the heel region into the toe region and subsequently moved back again. In the course of this movement, the displaced fluid is forced through the restricting channels 21 which form a constriction in the flow path of the fluid. As the fluid passes through the restricting channels 21, heat is generated and is released to the environment, thus causing the warming of the foot resting on the sole 1.

Figure 3:
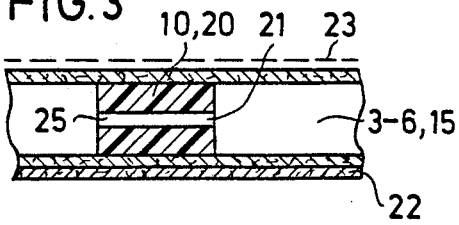
FIG. 3 is a cross-sectional view taken substantially along the line III—III of FIG. 2, showing a first embodiment of a flow restrictor for the device for heat generation shown in FIGS. 1 and 2.

FIGS. 3 to 6 show additional embodiments of the flow restrictors 10 and 20 containing restricting channels 21. In FIG. 3, the flow restrictor 10, 20 is of substantially rigid form. For example, the restrictor may be made of plastic in which the restricting channels 21 are arranged. The restricting channel 21 shown in FIG. 3 is designed in the form of a capillary 25 extending longitudinally of the sole. FIG. 3 also shows that the hollow bodies 3 to 6 or the cavity 15 may be covered with additional layers 22, 23, the layer 22, for example, being an insulating layer or constituting part of the leather of the shoe. The top layer 23 shown in broken lines can consist, for example, of leather, plastic or another suitable material which serves as a support surface for the foot.

Figure 4:
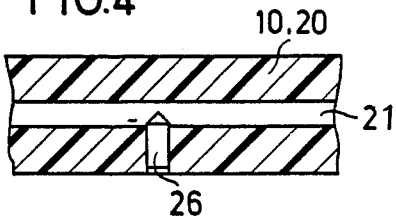
FIG. 4 illustrates on an enlarged scale as compared with FIG. 3, a cross section of a flow restrictor similar to that in FIG. 3 but having an adjustable constriction device.

The flow restrictor 10, 20 according to FIG. 4 likewise possesses as in the case of FIG. 3, a capillary-shaped restricting channel 21. A pin 26 adjustable in position is arranged in the body of this flow restrictor 10, 20 so that the fluid which passes through the channel 21 can be more or less constricted by means of the pin 26. This enables the evolution of heat in the flow restrictor 10, 20 to be adjusted.

Figure 5:
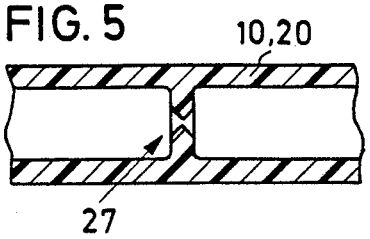
FIG. 5 illustrates a fragmentary cross-sectional view of a further embodiment of a flow restrictor employing a shutter.

As shown in FIG. 5, the flow restrictor 10, 20 can be provided with one or more shutters 27 instead of restricting channels 21. In FIG. 5, only a single restricting shutter 27 is shown, but it is also possible to arrange two or more shutters 27 in the body of the flow restrictor 10, 20.

Figure 6:
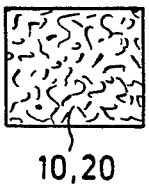
FIG. 6 is an enlarged cross-sectional view of a flow restrictor including a porous member.

The flow restrictor 10, 20 shown in FIG. 6 is in the form of a permeable, porous body through which the fluid displaced during walking is pressed.

The device for heat generation described is very simple in construction and also in its mode of action. It permits heat to be generated in an article of footwear without an additional energy source since only the alternating compressive forces exerted on the sole during walking are used for this purpose. This produces a simple and reliable design which can be incorporated either into the sole of the shoe, which may or may not be interchangeable, or in an insole. It is readily possible to keep the thickness of the device relatively slight, so that the sole does not become significantly thicker than a sole of conventional type.

It should be understood that the sole 1 can also be designed in various forms other than shown in the drawings. Thus, the cavities 11, 12, 13 and 14 can have any desired suitable form. It may be further of advantage in the embodiment according to FIG. 2 to subdivide the partial cavities 13, 14 by partitions extending in the longitudinal direction of the sole 1 in order to insure that the fluid, during walking, flows in the longitudinal direction of the shoe and not transversely thereto.

It will also be understood that the flow restrictors 1,, 20 can also take forms other than those shown in the drawings.

I claim as my invention:

1. A device for warming the foot during walking comprising:

an inner sole defining a plurality of longitudinally communicating closed cavities which deform under compressive stress, said cavities each containing a fluid therein, and a flow restrictor located in a region of a arch of the foot and including at least one restrictive shutter whereby heat is generated as a fluid passes through said flow restrictor during alternating application of stresses on said cavities during walking.

2. A device according to claim 1 wherein said flow restrictor is located in a region of an arch of said foot.

3. A device according to claim 2 wherein said flow restrictor includes at least one longitudinally extending restricting channel.

4. A device according to claim 3 which includes an adjusting means for varying the cross-section area of the restricting channel.

5. A device according to claim 1 wherein each cavity is subdivided into chambers extending substantially longitudinally within said inner sole.

6. A device according to claim 1 which includes a plurality of closed hollow members extending in a longitudinal direction of said sole, said closed hollow members extending adjacent one another and forming chambers which are divided into partial cavities by said constriction means.

7. A device according to claim 1 wherein said fluid exhibits substantially constant viscosity within a range of −30° C. and +40° C.

8. A device according to claim 1 in an form of an insole.

9. A device according to claim 1, wherein said device is footwear.

10. A device for warming a foot during walking comprising:

an inner sole defining a plurality of longitudinally communicating closed cavities which deform under compressive stress, said cavities each containing a fluid therein, and a flow restrictor located in a region of an arch of said foot and including a fluid permeable porous body, whereby heat is generated as said fluid passes through said flow restrictor during alternating application of stresses on said cavities during walking.

* * * * *